US009849362B2

(12) United States Patent
Nelson

(10) Patent No.: US 9,849,362 B2
(45) Date of Patent: Dec. 26, 2017

(54) MOTORIZED MACHINE THAT SIMULATES MARTIAL ARTS SPARRING

(71) Applicant: Jonathan Cameron Nelson, Brooklyn, NY (US)

(72) Inventor: Jonathan Cameron Nelson, Brooklyn, NY (US)

( * ) Notice: Subject to any disclaimer, the term of this patent is extended or adjusted under 35 U.S.C. 154(b) by 0 days.

(21) Appl. No.: 15/282,513

(22) Filed: Sep. 30, 2016

(65) Prior Publication Data

US 2017/0014699 A1 Jan. 19, 2017

Related U.S. Application Data

(63) Continuation-in-part of application No. 14/462,592, filed on Aug. 19, 2014, now Pat. No. 9,504,893, (Continued)

(51) Int. Cl.
*A63B 21/06* (2006.01)
*A63B 24/00* (2006.01)
(Continued)

(52) U.S. Cl.
CPC ..... *A63B 69/004* (2013.01); *A63B 21/06* (2013.01); *A63B 24/0087* (2013.01);
(Continued)

(58) Field of Classification Search
CPC ..... A63B 21/00058; A63B 21/00069; A63B 21/00072; A63B 21/00076; A63B 21/00178; A63B 21/00181; A63B 21/00185; A63B 21/005; A63B 21/0058; A63B 21/0059; A63B 21/06; A63B 21/068; A63B 21/08; A63B 21/15; A63B 21/159; A63B 21/22; A63B 21/222; A63B 21/225; A63B 21/227; A63B 21/4027; A63B 21/4033; A63B 21/4034; A63B 21/4035; A63B 21/4045; A63B 21/4047; A63B 21/4049; A63B 23/0205; A63B 23/0211; A63B 23/0216; A63B 23/0222; A63B 23/0227; A63B 23/0405; A63B 23/0482; A63B 23/0488; A63B 23/0494;
(Continued)

(56) References Cited

U.S. PATENT DOCUMENTS 2,088,861 A * 8/1937 Klum ..... A63B 69/345 114/219
2,547,124 A * 4/1951 Hudson ..... A63B 69/205 248/341

(Continued)

*Primary Examiner* — Andrew S Lo
*Assistant Examiner* — Gary D Urbiel Goldner
(74) *Attorney, Agent, or Firm* — Benjamin Davis

(57) ABSTRACT

The present invention concerns a machine for martial arts training that simulates sparring with a live partner and provides a safe tool for body hardening. More specifically, the machine is a vertical alignment of three independently rotatable Alpha Bodies having detachable arms, a weighted base, and bearing interfaces, where each Alpha Body may rotate to initiate strikes via programmable servo motors. The present invention facilitates martial arts offensive strikes and defensive moves, which safely promotes the formation of calcium deposits and scar tissue about key nerve areas to give the body a hardened feel.

17 Claims, 11 Drawing Sheets

1a

1b

Related U.S. Application Data which is a continuation-in-part of application No. 13/797,672, filed on Mar. 12, 2013, now abandoned.

(51) Int. Cl.

| | |
|---|---|
| ***A63B 69/00*** | (2006.01) |
| ***A63B 69/20*** | (2006.01) |
| ***A63B 69/34*** | (2006.01) |
| ***A63B 71/02*** | (2006.01) |
| ***A63B 71/06*** | (2006.01) |

(52) U.S. Cl.

CPC ..... *A63B 69/20* (2013.01); *A63B 69/205* (2013.01); *A63B 69/34* (2013.01); *A63B 71/0622* (2013.01); *A63B 71/023* (2013.01); *A63B 2071/026* (2013.01); *A63B 2207/02* (2013.01); *A63B 2210/50* (2013.01); *A63B 2225/09* (2013.01)

(58) Field of Classification Search

CPC . A63B 23/12; A63B 23/1209; A63B 23/1245; A63B 23/1281; A63B 24/0075; A63B 24/0087; A63B 2024/0078; A63B 2024/0081; A63B 2024/009; A63B 2024/0093; A63B 2024/0096; A63B 69/004; A63B 69/20; A63B 69/201; A63B 69/203; A63B 69/205; A63B 69/206; A63B 69/208; A63B 69/24; A63B 69/26; A63B 69/32; A63B 69/325; A63B 69/34; A63B 69/345; A63B 2069/0042; A63B 2069/0044; A63B 71/0054; A63B 71/023; A63B 71/04; A63B 71/0619; A63B 71/0622; A63B 71/0686; A63B 2071/0063; A63B 2071/0081; A63B 2071/009; A63B 2071/025; A63B 2071/026; A63B 2071/027; A63B 2071/0647; A63B 2071/065; A63B 2071/0658; A63B 2071/0675; A63B 2071/0683; A63B 2071/0694; A63B 2207/00; A63B 2207/02; A63B 2208/0204; A63B 2208/0209; A63B 2210/50; A63B 2225/09; A63B 2225/093; A63B 2225/10; A63B 2225/102; A63B 2225/105; A63B 2225/107; A63B 2225/20; A63B 2244/10; A63B 2244/102; A63B 2244/104; A63B 2244/106; A63B 2244/108

See application file for complete search history.

(56) References Cited

U.S. PATENT DOCUMENTS 4,749,184 A * 6/1988 Tobin ..... A63B 69/0091 482/129
4,911,428 A * 3/1990 Wiece ..... A63B 69/201 248/325
4,940,228 A * 7/1990 Horvath ..... A63B 69/34 273/386
5,267,485 A 12/1993 Chi
5,352,170 A * 10/1994 Condo ..... A63B 69/201 482/83
5,389,057 A * 2/1995 Zagata, Jr. ..... A63B 69/004 482/83
D356,127 S * 3/1995 Mara ..... D21/798
5,496,204 A * 3/1996 Brown ..... A63B 5/22 273/440
5,613,925 A * 3/1997 Miasserian ..... A63B 69/0053 482/83
5,722,920 A * 3/1998 Bauer ..... A63B 69/004 482/83
5,725,193 A 3/1998 Adams
5,863,278 A 1/1999 Chen
5,899,835 A * 5/1999 Puranda ..... A63B 69/208 482/83
6,220,992 B1 4/2001 Shafik
6,254,115 B1 7/2001 Lin
6,398,697 B1 * 6/2002 Nichols, Jr. ..... A63B 69/20 473/441
7,329,210 B1 * 2/2008 Marano ..... A63B 69/004 482/83
7,416,517 B2 8/2008 Mitchell
7,513,853 B1 * 4/2009 Russ ..... A63B 22/0056 482/28
8,033,963 B1 * 10/2011 Jones ..... A63B 21/154 482/100
8,602,944 B2 12/2013 Fleitz
9,744,420 B1 * 8/2017 Bergamini ..... A63B 69/004
2002/0013198 A1 * 1/2002 Mackay ..... A63B 69/004 482/79
2004/0176222 A1 * 9/2004 Mitchell ..... A63B 69/004 482/83
2004/0209743 A1 * 10/2004 Perez ..... A63B 69/34 482/83
2005/0181913 A1 * 8/2005 Vang ..... A63B 69/34 482/83
2006/0025284 A1 2/2006 Livingston et al.
2007/0167297 A1 * 7/2007 Stevenson ..... A63B 69/004 482/83
2008/0119335 A1 * 5/2008 Luigi ..... A63B 69/20 482/89
2008/0220949 A1 9/2008 Yang
2008/0254950 A1 10/2008 Beliles
2010/0179031 A1 * 7/2010 Luigi ..... A63B 69/004 482/89
2011/0015040 A1 * 1/2011 Fleitz ..... A63B 69/004 482/8
2012/0040804 A1 * 2/2012 Detterberg ..... A63B 69/0053 482/83
2013/0059699 A1 * 3/2013 Brenner ..... A63B 69/004 482/83
2013/0231223 A1 * 9/2013 Scully ..... A63B 69/20 482/87
2014/0302969 A1 * 10/2014 Chen ..... A63B 69/203 482/90
2016/0023078 A1 * 1/2016 Haselrig ..... A63B 69/004 482/87
2017/0173377 A1 * 6/2017 Zaykov ..... A63B 5/22

* cited by examiner

MOTORIZED MACHINE THAT SIMULATES MARTIAL ARTS SPARRING

CROSS REFERENCE TO RELATED APPLICATIONS

This application is a divisional patent application of patent application Ser. No. 14,462,592 filed on Aug. 19, 2014. Patent application Ser. No. 14,462,592 is a continuation in part of, and claims priority to, patent application Ser. No. 13/797,672 filed on Mar. 12, 2013.

FIELD OF THE INVENTION

The present invention concerns a machine for martial arts training that simulates sparring with a live partner and provides a safe tool for body hardening. More specifically, the machine is a vertical alignment of three independently rotatable Alpha Bodies having detachable arms, a weighted base, and bearing interfaces, where each Alpha Body rotates when met by force from a user or may rotate to initiate strikes via programmable servo motors. The present invention facilitates martial arts offensive strikes and defensive moves, which safely promotes the formation of calcium deposits and scar tissue about key nerve areas to give the body a hardened feel.

BACKGROUND OF THE INVENTION

Martial artists train and stay in shape by fighting one another in sparring matches. Sparring with a live partner has many advantages. It increases the possibility to develop fighting sequences and new modes of performance, enhances timing and balance techniques, decreases the risk of injury, presents an opportunity to practice throwing and falling skills, helps to develop strike and defense timing, simulates strikes and kicks with real-fight power and speed, raises sensitivity to opponents, and increases one's endurance and tolerance for pain.

Many martial artists seek to harden the body to increase their tolerance to pain through dangerous alternatives to sparring events. It is desirable to harden body areas like the shins, calves, inner and/or outer thigh, ribs, stomach, arms, hands, shoulders, kidneys, or back. They strike hard objects to "deaden" certain never and pain receptors in the body. Minor injuries from the strikes create micro fractures in bone and damage tissue near nerves giving the body a harden feel when calcification and scar tissue form during micro fracture healing. However, not properly executed, these techniques can cause serious injuries to anyone.

U.S. Pat. No. 6,220,992 to A. M. Shafik discloses a boxing exercise machine.

U.S. Pat. No. 5,863,278 to James Chen et al. discloses a boxing drill machine.

U.S. Pat. No. 5,267,485 to Donald W. Mitchelle discloses an interactive martial arts training machine.

U.S. Patent Pub. No. 2006/0025284 to J. F. Livingstone et al. concerns a portable exercise device having a base, which holds a pole in a vertical position having two arms.

U.S. Pat. No. 5,941,801 to L. D'Alto concerns a multi-directional combination boxing and kicking bag.

U.S. Pat. No. 6,872,171 to D. Haselrig concerns a martial arts training bag.

None of the above disclosures show a machine that simulates the advantages of martial arts sparring with a live partner, where the machine uses a vertical alignment of Alpha Bodies rotated by programmable servo motors having detachable arms that strike key nerve areas to facilitate body hardening in a safe manner while. To that end, there is a need for the present invention.

SUMMARY OF THE INVENTION

The primary object of the present invention provides for a body hardening machine that simulates martial arts sparring that includes an upper, a mid, and a lower Alpha Body that are vertically aligned and secured by interfaces at two locations and wherein each Alpha Body interface is rotated by at least one programmable servo motor. The interfaces are located firstly between a bottom distal end of the upper Alpha Body and a top distal end of the mid Alpha Body and a secondly between a bottom distal end of the mid Alpha Body and a top distal end of the lower Alpha Body. Each interface includes an upper press fit bearing cup and a lower press fit bearing cup. The upper press fit bearing cup has a race for accepting an upper retaining ring with bearings. The lower press fit bearing cup has a race for accepting a lower retaining ring with bearings. The press fit bearing cups each have holes for accepting threaded bolts about an outer surface thereof. The retaining rings with bearings each have a modified flange with holes for accepting the respective threaded bolts. The invention further includes a washer with a race at one surface thereof for accepting the upper retaining ring with bearings. The washer has a radially extending lip from another surface thereof for accepting the race of the lower press fit bearing cup. The washer further has a threaded bore for accepting a central threaded bolt which, when tightened, creates a compression socket for the interface, coupling the press fit bearing cups together. The invention also includes an upper half ring and a lower half ring. The upper half ring is coupled to the outer surface of the upper press fit bearing cup, and the lower half ring is coupled to the outer surface of the lower press fit bearing cup. The half rings each have holes for accepting the respective threaded bolts.

An aspect of the present invention includes a bottom distal end of the lower Alpha Body being friction fit with a bottom press fit bearing cup having a bottom retaining ring with bearings and is supported by a balanced base that includes a ring having a circular cross section, a cavity, and four legs equally spaced about its circumference. Each leg pivots and radiates outwardly and downwardly terminating at a boss having holes sized and positioned to vertically accept a sleeve from a dumbbell like balance.

An aspect of the present invention includes a programmable servo motor being programmed with rotation sequences that mimic strikes from a live sparring partner and operates at speeds that are capable of delivering from 25 lbs [111.20 N] to 800 lbs [3558.57 N] of force to cause micro fractures to key nerve areas of a user by each pair of arms.

Yet another aspect of the present invention includes the programmable servo motor having a dual drive shaft type motor secured to and suspended in the inner cavity of the mid Alpha Body by a mounting bracket that is attached to and rests on a large servo arm that extends to the inner walls of the mid Alpha Body and is secured to the same with bolts that are tightened into brackets that extend from the inner walls of the mid Alpha Body. The dual shafts of the servo motor are mated to an upper shaft extension and a lower shaft extension via servo horns located at the ends of each shaft. The upper and lower extensions pass through an upper servo arm and a lower servo arm both connected to the inner walls of the upper and lower Alpha Bodies.

An aspect of the present invention includes a programmable servo motor having a single drive shaft that is secured to and suspended in the inner cavity of a base by a mounting bracket. The mounting bracket is secured to the inner walls of the base by bolts that are tightened into three equally spaced brackets that extend from the inner walls of the base. The single drive shaft is pointed upwards into the cavity of the machine and is connected to a single drive shaft extension via a disc type servo horn. The singular drive extension passes through the centers of a lower, a mid, and an upper servo arm, where each of the upper, mid, and lower servo arms extend to both sides of its respective Alpha Body's inner cavities and are secured by bolts that pass through and are tightened into brackets that extend from these inner walls of each Alpha body and mate with either side of each servo arm.

An aspect of the present invention includes a programmable servo motor that is secured to and suspended in the inner cavity of an Alpha Body and is oriented to have its single drive shaft pointing downwards into a disc shape servo horn that is friction fitted into a hole about a rubber disc. The hole in the rubber disc is sized to the outer diameter of the servo horn. The programmable servo motor is secured onto the rubber disc by a front mounting bracket. The rubber disc is cut to have an outer diameter that allows the disc to set flush against the inner walls of an Alpha Body. Each rubber disc rests between spaces cut into stabilizing rods that run the length of the inside of the machine.

An aspect of the present invention includes a programmable servo motor being secured to and suspended in the inner cavities of the upper, mid, and lower Alpha Bodies. Each of the three programmable servo motors are oriented to have its drive shaft pointing downwards into a disc shape servo horn that is friction fitted into a hole about a rubber disc. Each hole in each of the rubber discs are sized to the outer diameter of each of the three servo horns. Each programmable servo motor is secured onto each rubber disc by a front mounting bracket. Each of the three rubber discs are cut to have an outer diameter that allows each rubber disc to set flush against the inner walls of the upper, mid, and lower Alpha Body, and each of the three rubber discs rest between spaces cut into stabilizing rods that run the length of the inside of the machine.

An aspect of the present invention includes each Alpha Body having a pair of detachable arms.

Still another aspect of the present invention includes the upper, the mid, and the lower Alpha Bodies being independently rotatable at the interface located between the bottom distal end of the upper Alpha Body and the top distal end of the mid Alpha Body, and the interface located between the bottom distal end of the mid Alpha Body and the top distal end of the lower Alpha Body.

An aspect of the present invention includes each dumbbell like balance being a construct having a threaded shaft and the sleeve, bolts, and a bottom disc plate and an upper disc plate, and the bottom disc plate is weighted.

An aspect of the present invention includes each detachable arm of the pair of detachable arms being strategically placed so that a user may strike or defend strikes from the machine at targeted nerve areas on their forearms, torso, and/or thighs including: a radial nerve (top of the forearm), a ulnar nerve (underside of the forearm), a peroneal nerve (outside of thigh), a femoral nerve (inside of the thigh), and the abdomen (mid torso). These strikes to or from the user to the pair of detachable arms safely promotes the formation of calcium deposits and scar tissue about these nerve areas to give the body of the user a hardened feel.

An aspect of the present invention includes the sleeve of each dumbbell like balance being vertically passed through the hole located at the boss of each leg. The sleeve acts as an axial shaft for receiving a plurality of weights. The plurality of weights being circular discs with axial holes slightly larger than a diameter for each sleeve, and where the weight is slipped over and onto each sleeve.

An aspect of the present invention includes a top of the upper Alpha Body being covered by a lid that is connected to a pull up bar and boxing speed bag.

Yet another aspect of the present invention includes six points of rotation being created that includes a top retaining ring with bearings located between a lid and the upper Alpha Body, an interface located between the upper and mid Alpha Bodies, an interface located between the mid and lower Alpha Bodies, and a bottom retaining ring with bearing located between the lower Alpha Body and a base.

An aspect of the present invention includes a machine where the ends of each pair of detachable arms are easily fitted with a pair of boxing or kicking pads, giving the user the feel of a simulated striking practice for targeted jabs and kicks. The striking pads can be jointly connected to the ends of the arms to give each boxing or kicking pad a point of articulation and simulates the movement of a human wrist when struck.

An aspect of the present invention includes a machine where the ends of each pair of detachable arms are easily fitted with a pair of boxing or kicking pads having lighting elements including diodes, fiber optics, and the like, or any combinations thereof connected to an electrical timing circuit that gives lighted sequences about the pads being striking sequences for the user to follow.

It is an aspect of the present invention for the machine that simulates martial arts sparring of to have at least one programmable servo motor connected to at least one motion controller that controls the speed, torque, and direction of the motor via a touch pad or a touch pad display and includes a programmable logic controller for controlling voltages to the electric servo motor that allows the user to program motion sequences that rotates the Alpha Bodies to initiate striking patterns for a user to block.

Other objects, advantages, and novel features of the invention will become more apparent from the following detailed description when taken in conjunction with the accompanying drawings.

BRIEF DESCRIPTION OF THE DRAWINGS

The figures discussed below are non-limiting examples of the present invention and are not meant to serve as a limitation thereof.

DETAILED DESCRIPTION OF THE INVENTION

Definitions

To detail the present invention, the following non-limiting terms are used:

The term "Alpha Body(ies)" generally refer(s) to one rotatable cylindrical shell having detachable arms, retaining rings with bearings, press fit bearing cups with bearing races, a balanced base, half rings and bolts, flanged washer, and compression sockets, wherein the cylindrical shell may include a piece of cut sheet metal that has been rolled into a hemispherical shape where the edges are fastened or welded smooth to form a cylinder.

The term "machine" generally refers to a body hardening device that simulates sparring in the martial arts that includes a vertical alignment of three independently rotating Alpha Bodies with six points of rotation all supported by a balanced base. Each Alpha Body is a cylindrical shell having press fit bearing cups at their distal ends, a pair of detachable arms, upper and lower bearing assemblies, and a pull up bar and boxing speed bag located at the top of the upper Alpha Body.

The terms "base" or "balanced base" generally refer to a circular base having four equally spaced legs around its circumference that pivot a radiate downward and outward towards a floor and have four balances with shafts capable of supporting disc shaped weights.

The term "bearing assembly" generally refers to either a flanged retaining ring with bearings that roll along a race located in a press fit bearing cup on either distal end of an Alpha Body or an interface where two Alpha Bodies meet on the vertical alignment of Alpha Bodies where two points of rotation meet.

The term "point of rotation" generally refers to a point along the vertically aligned Alpha Bodies that can freely rotate either by a bearing assembly or by a friction fit, typically being the point at a press fit cup at either distal end of all Alpha Bodies when vertically stacked.

The term "balance" generally refers to a dumbbell like construct that includes a threaded shaft and sleeve, bolts, and a bottom and upper disc plate. The bottom disc plate is weighted to give the machine a more secure balance.

The terms "vertical alignment" "vertically aligned" or "vertically stacked" generally refer to a vertical column formed when the upper, mid, and lower Alpha Bodies are stacked on each other forming at least one interface having a bearing assembly. A total of six points of rotation are created that includes a top retaining ring with bearings located between a lid and the upper Alpha Body, an interface located between the upper and mid Alpha Bodies, another interface located between the mid and lower Alpha Bodies, and a bottom retaining ring with bearing located between the lower Alpha Body and a base.

General Embodiment of the Invention

The Body Hardening Machine

Figure 1:
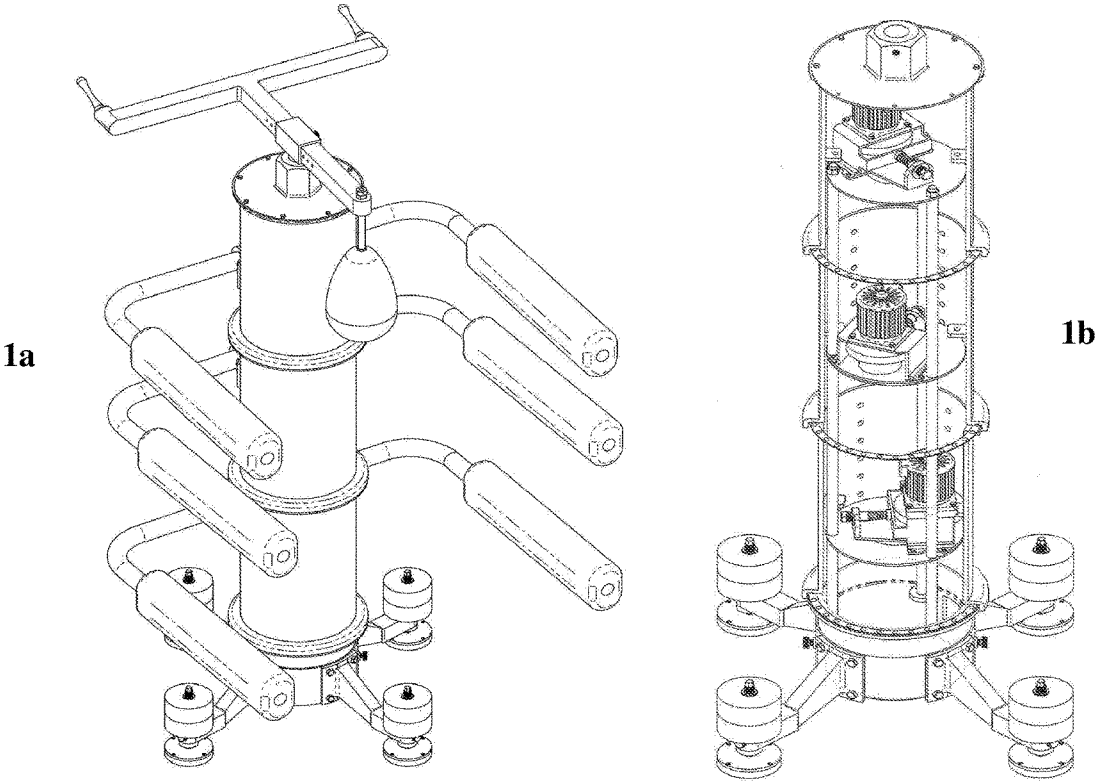
FIG. 1 shows both a front view 1*a* and a cut away view 1*b* for a machine that simulates martial arts sparring for body hardening. The front view 1*a* depicts the sparring machine having three rotatable Alpha Bodies that are vertically aligned, each having a pair of detachable padded arms that are vertically moveable about the back area of each Alpha Body, a balanced base, a pull up bar, and an overhanging speed bag. The cut away view 1*b* shows an non-limiting embodiment of the invention where each of the three Alpha Bodies are individually rotated by their own inner servo motor located just above a lower interface for rotating each of the same.

From this point forward, the following words will describe the present invention. However, these words are not a limitation on the scope of the present invention, but are shared to illustrate certain embodiments thereof. From FIG. 1, the present invention is a machine 1*a* that facilitates martial arts offensive strikes and defensive moves, which safely hardens the body through the healing of micro fractures and the forming of scar tissue about key nerve areas. Although strikes from a user can cause Alpha Bodies to rotate, a preferred embodiment is for programmable servo motors 1*b* to independently rotate each Alpha Body, thereby making contact with the user.

Figure 2A:
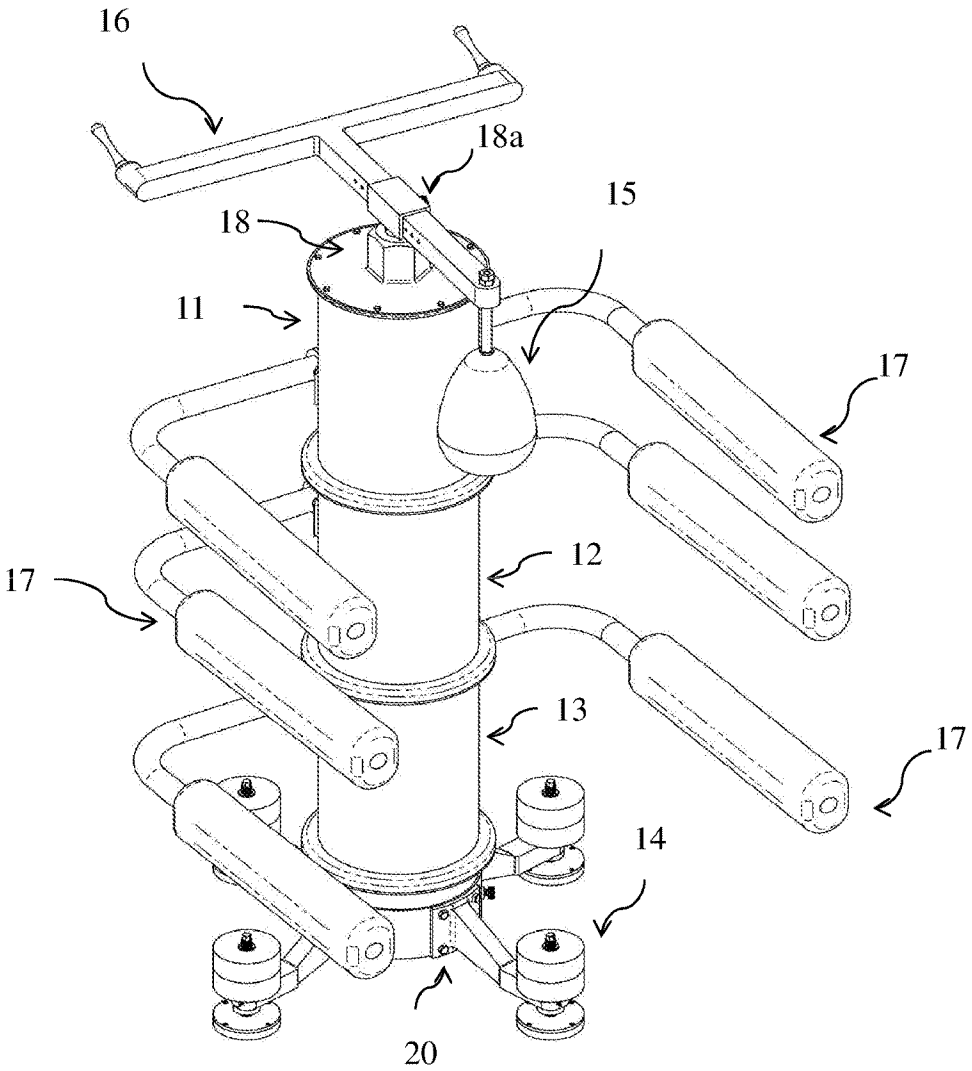
FIG. 2*a* is a front view of the present invention showing the machine for simulating martial arts sparring 10 having three rotatable Alpha Bodies 11, 12, and 13 each vertically aligned and fitted with a pair of padded arms 17 that are detachable and vertically moveable about the back area of each Alpha Body, a balanced base 20 with weights 14, a pull up bar 16, and an overhanging speed bag 15.
Figure 8:
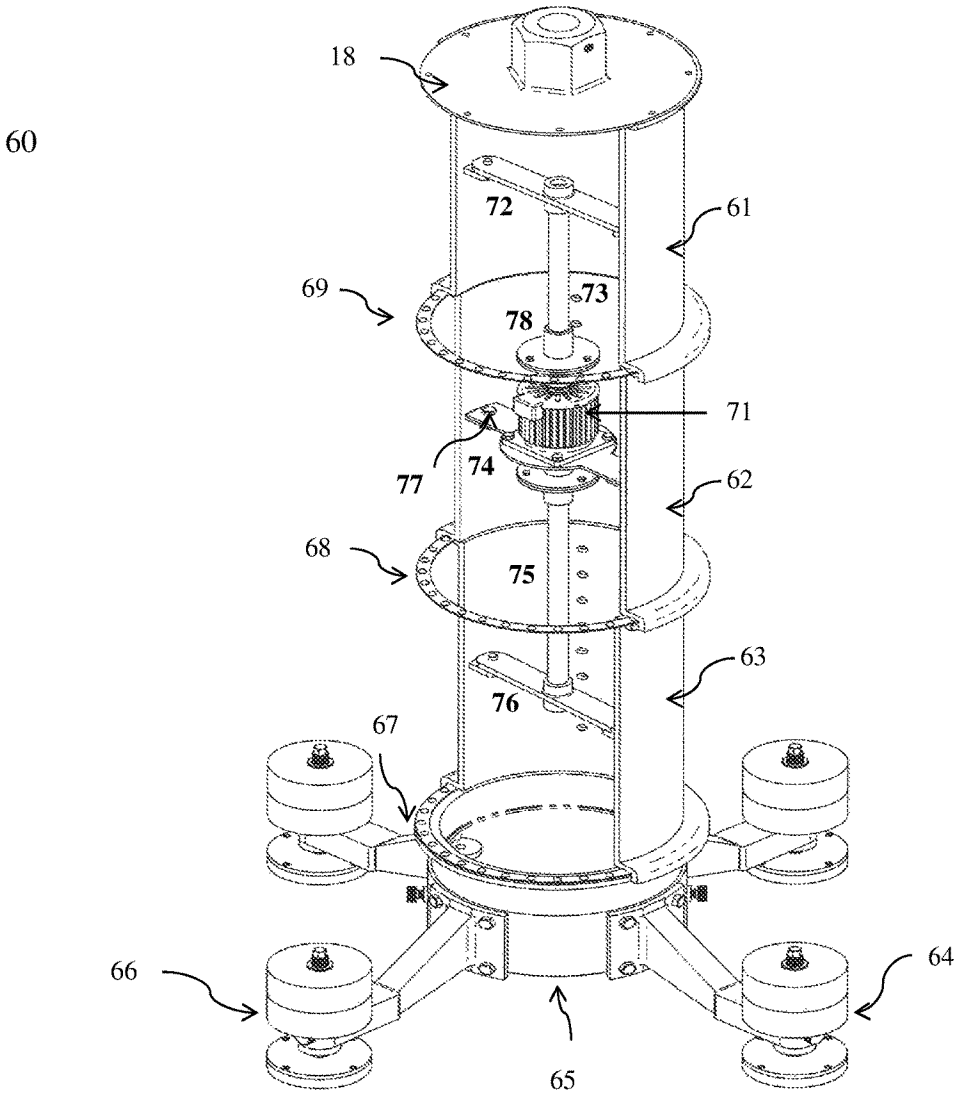
FIG. 8 is a cross section depicting the innards of the machine 60 with an industrial servo motor 71 having a dual shaft. The upper and lower shafts of the electric servo motor 71 are connected to an upper shaft extension 73 and a lower shaft extension 75 that pass through an upper servo arm 72 and a lower servo arm 76. Two disc type servo horns 78 connect the motor's 71 upper and lower drive shafts to the upper extension 73 and lower extension 75. The servo motor 71 sits flush within a cavity of a mounting bracket 74. The mounting bracket 74 is attached to and rests on a large servo arm 77 that extends to the inner walls of the mid Alpha Body 62 and is secured to the same with bolts that are tightened into brackets that extend from the inner walls of the mid Alpha Body 62. The electric servo motor 71 transmits rotational motion to the dual drive shafts, through the upper 73 and lower extensions 75, and finally to the upper 72 and lower 76 servo arms. This embodiment will cause the upper Alpha Body 61 and the lower Alpha Body 63 to rotate according to the programming of the servo motor 71.

From FIG. 2*a*, the machine 10 includes a vertical alignment of an upper 11, mid 12, and lower 13 Alpha Body, where each are independently rotatable from the other using a series of retaining rings with bearings, press fit bearing cups with races, flanged washers, compressions sockets, connecting bolts, and at least one inner servo motor (see cut away FIG. 8). The lower alpha 13 body is associated with a base 20 having four balances 14. Each Alpha Body 11, 12, and 13 is a cylindrical shell having two arms 17 that are bolted with a bracket into holes in the back portion of the same and may rotate from zero degrees (0°) up to about ninety degrees (90°) in either direction normal to their vertical alignment.

However, it is a preferred embodiment of the present invention where rotation is from about zero degrees (0°) up to about forty five degrees (45°) in either direction normal to their vertical alignment. Strikes to or from the machine 10 is designed to target and calcify bone tissue near nerve areas on the user's forearms, torso, or thighs. The present invention includes a speed bag 15 and pull-up bar 16 to provide options for a more complete workout.

Figure 2B:
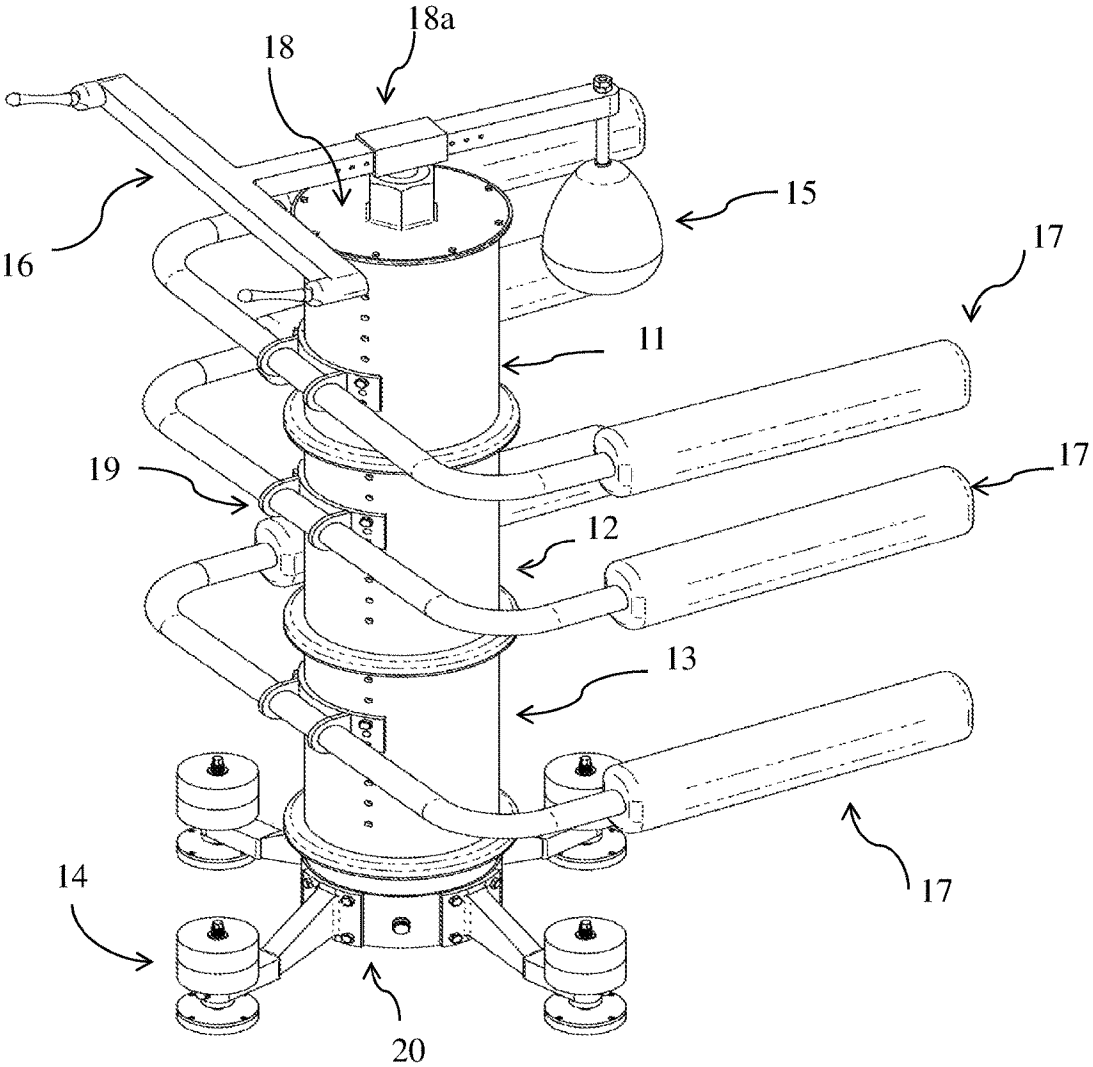
FIG. 2*b* is a rear view of the present invention showing the machine for simulating martial arts sparring 10 having three rotatable Alpha Bodies 11, 12, and 13, each vertically aligned and fitted with a pair of padded arms 17 that are detachable and vertically moveable 19 about the back area of each Alpha Body 11, 12, and 13, a weighted base 20 and weights 14, a pull up bar 16, and an overhanging speed bag 15.

Behind the machine 10, FIG. 2*b*, each Alpha Body 11, 12, and 13 has a pair of detachable striking arms 17 that connect to and extend outward from their back area to face the user. The arms 17 are symmetrical U shaped tubes having pads about their outer limbs. Each pair of arms 17 is connected to the back portion of each Alpha Body 11, 12, and 13 with a bolted bracket 19 into holes about the same and may be detached when needed.

It is an embodiment of the present invention wherein the ends of each arm 17 may be easily fitted with a pair of boxing or kicking pads, giving the user the feel of a simulated striking practice for targeted jabs and kicks. Although not shown, these striking pads can be jointly connected to the ends of the arms to give each boxing or kicking pad a point of articulation and simulates the movement of a human wrist when struck. The boxing or kicking pads may have lighting elements, non-limiting examples being diodes, fiber optics, and the like, connected to an electric timing circuit that gives lighted sequences about the boxing or kicking pads for the user to follow. It is an embodiment of the present invention wherein the arms 17 may also have a wishbone type shape or an extended curve like shape to give the machine 10 a more stream lined look.

Each pair of arms 17 is parallel to the vertical plane of alignment created by the stacked Alpha Bodies 11, 12, and 13. When in use, the machine's 10 upper arms 17 are typically from about shoulder level to about face level but can also be located to strike one's upper torso at or below one's shoulders to about one's elbows. The mid Alpha Body's 12 arms 17 are situated near or at one's mid torso to about one's waist area, and arms 17 for the lower Alpha Body 13 are situated from about mid thigh level to about knee level. To reiterate, holes are provided at the back portion of each Alpha Body 11, 12, and 13 to adjust the vertical height of the arms 17 or to totally detach them.

The machine's 10 arms 17 are strategically placed such that a user may strike or defend strikes from the machine 10 at targeted nerve areas on their forearms, torso, and/or thighs. These nerve points may be repeatedly struck by Alpha Body arms 17, where strikes around key nerve areas harden tissue. These nerve areas include without limitation: the radial nerve (top of the forearm), the ulnar nerve (underside of the forearm), the peroneal nerve (outside of thigh), the femoral nerve (inside of the thigh), and the abdomen (mid torso).

An Alpha Body's 11, 12, and 13 rotation is propelled by force from a user's strike to any of the arms 17. The harder one hits the arms 17 the faster the Alpha Bodies 11, 12, and 13 will rotate. This momentum causes any of the arms 17 to come into a striking range for one to interact with the machine 10 to either block or strike the same. Alternatively, rotating the Alpha Bodies 11, 12, and 13 can also be achieved by a servo motor or series of servo motors to facilitate defensive moves, where key nerve areas are struck by the machine 10.

Alpha Body Construction and Rotation

Figure 3:
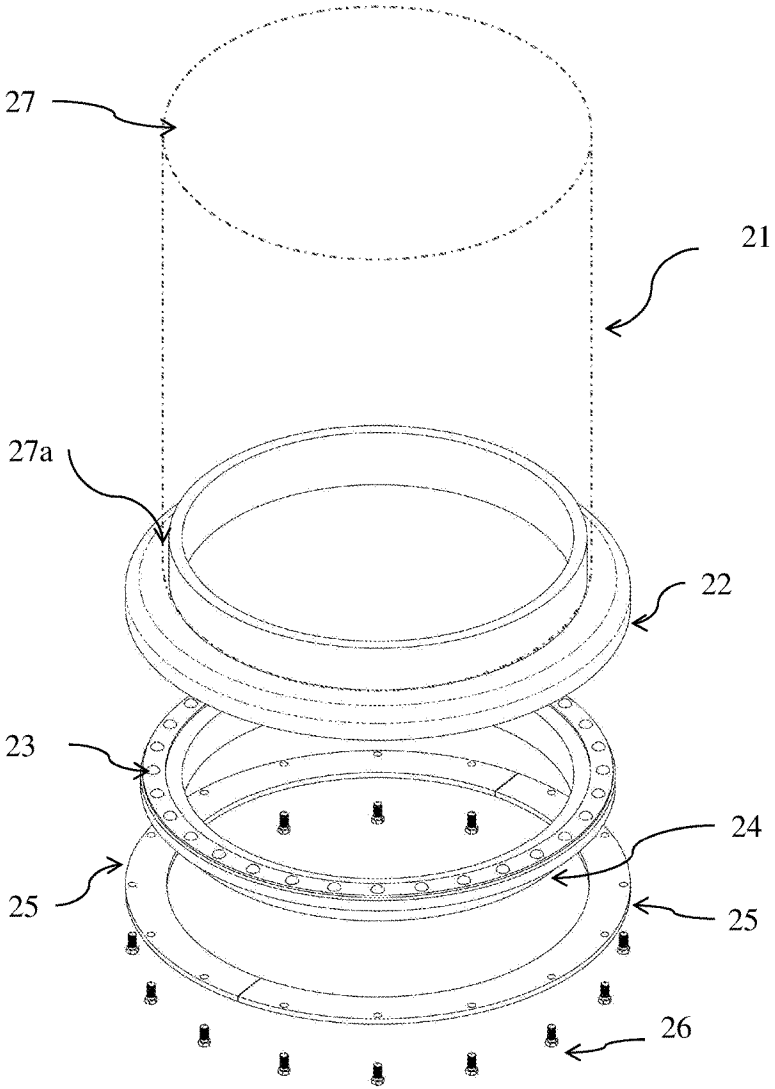
FIG. 3 depicts a single bearing assembly located at a lower distal end 27*a* of a cylindrical shell. The assembly includes a press fit bearing cup 22, a retaining ring with ball bearings 23, 24, and two half rings 25 with bolts 26 used to restrict vertical movement. This assembly may be inverted and repeated at the cylindrical shell's top distal end 27 creating two points of rotation for an Alpha Body based solely on bearings.

FIG. 3 shows the basic design for each Alpha Body, which includes a cylindrical shell 21, a press fit bearing cup 22, a flanged retaining ring with bearings 23, 24, and two half rings 25 and bolts 26. For simplicity, only the bottom assembly is shown, but it is an embodiment of the present invention wherein this design is inverted and repeated and used at the top distal end 27 of each cylindrical shell, depicted here by a dash dotted cylinder. Although each Alpha Body rotates independently from the other, they all share this design. However, when none of the Alpha Bodies have any bearings at their top distal ends, rotation is facilitated by friction.

An Alpha Body is a construct that includes a cylindrical shell 21 with two distal ends 27, 27*a*. Each end is friction fitted with a press fit bearing cup 22, being a cup like flange with one end having a built in race for the bearings 23 to roll along and the other end having a lip that vertically extends and friction fits into the inner surface of the cylindrical shell 21.

A flanged retaining ring 24 holds a set of ball or roller bearings 23 that fit neatly into the race of the press fit bearing cup 22, where the bearings 23, without limitation, may be about 0.25 inches in diameter to about 1.0 inches in diameter. To restrict vertical movement when the arms or a body of the machine are struck, the lower lip or surface of the flanged retaining ring 24 has holes to receive securing bolts 26 that pass through two half rings 25 located about the outer surface of the press fit bearing cup 22 and into the holes of the flanged retaining ring 24. This vertically stabilizes the machine and ensures a smooth rotation when met by force from the user.

The machine has six points of rotation, where there is one point of rotation located at the top and bottom of each Alpha Body. Rotation can be facilitated by having a ball bearing assembly at each rotation point or by having a ball bearing at the bottom of each Alpha Body, which allows for friction rotation at the top for each of the same. Although having a two bearing assemblies will allow for smoother rotations when an Alpha Body is struck by force, for simplicity in FIG. 3, only the lower ball bearing assembly is shown and the top portion of the cylindrical shell will rotate via friction. It is a preferred embodiment of the invention wherein the lower bearing assembly shown is inverted and repeated at the top distal end of the cylindrical shell, where the upper assembly is constructed identical to the lower assembly shown and is also vertically stabilized by two half rings 25 located about the top outer portion of the press fit bearing cup 22 by bolts 26*a* and 26*b* secured into a flanged retaining ring 24 (see FIG. 5).

Figure 5:
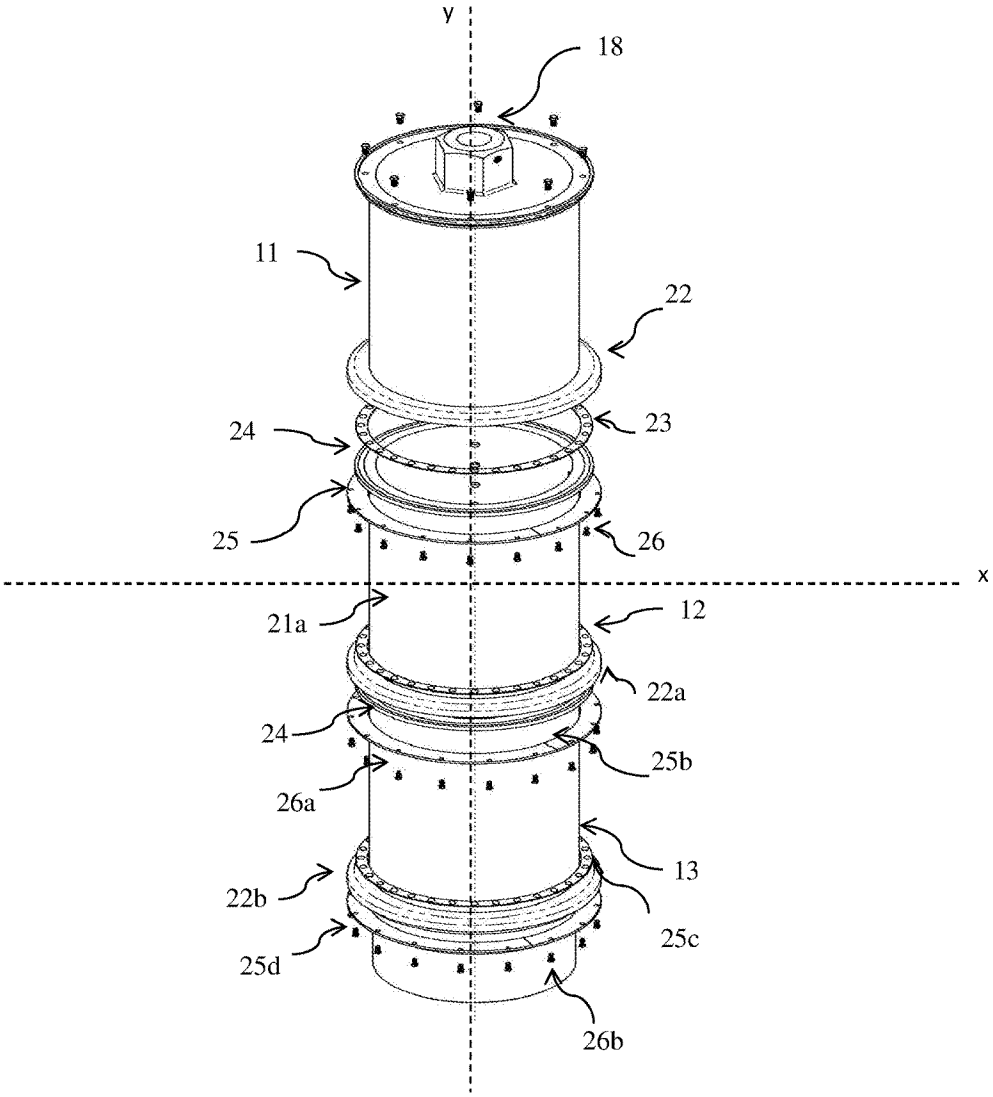
FIG. 5 is an exploded view of a vertically aligned upper 21, mid 21*a*, and lower 21*b* alpha bodies. A simple x-y axis shows the center point of the machine and the interfaces that create the various points of rotation for each Alpha Body.

FIG. 5 is an exploded view that emphasizes how the upper, mid, and lower Alpha Bodies are assembled and stacked. The machine has three Alpha Bodies 21, 21*a*, and 21*b*, each having press fit bearing cups 22, 22*a*, 22*b*, that rest on a flanged retaining ring with bearings 23 and 24, half rings 25, 25*a*, 25*b*, 25*c*, and 25*d*, bolts 26 and 26*a*, and a top lid 18 to cover the upper Alpha Body cavity and to support the pull up bar and speed bag. For clarity, the arms for each Alpha Body 21, 21*a*, and 21*b*, the pull up bar and speed bag, and the base are not shown but are still intended to be essential to the machine.

From FIG. 5, a vertical column is formed when the upper 21, mid 21*a*, and lower 21*b* Alpha Bodies are stacked on each other. A bearing assembly having a press fit bearing cup 22 with a race for bearings 23 to roll along, flanged retaining ring 24 with bearings 23, and two half rings 25, 25*a*, 25*b*, 25*c*, 25*d* and bolts 26, 26*a*, 26*b* are located between the upper Alpha Body's 11 bottom distal end and the mid Alpha Body's 12 top distal end. This bearing assembly is inverted and repeated at the mid Alpha Body's 12 bottom distal end and the lower Alpha Body's 13 top distal end. The lower Alpha Body 13 rests on a similar bearing assembly between its lower distal end and the top surface of the base (not shown). Another bearing assembly may be located between the upper Alpha Body's 11 top distal end and the top lid 18. The x-y graph shows the center point of the invention being the mid Alpha Body 12. Half rings 25, 25*a*, 25*b*, 25*c*, and 25*d*, secure the Alpha Bodies 11, 12, 13 to reduce any vertical movement when the machine is struck. This design ensures that the Alpha Bodies 11, 12, 13 can rotate in either direction from about 0° to about 90° when in use. In this embodiment the top distal ends for each Alpha Body 11, 12, 13 is devoid of a bearing assembly and rotates by friction.

Independent Rotation with a Two Bearing Assembly

Figure 4:
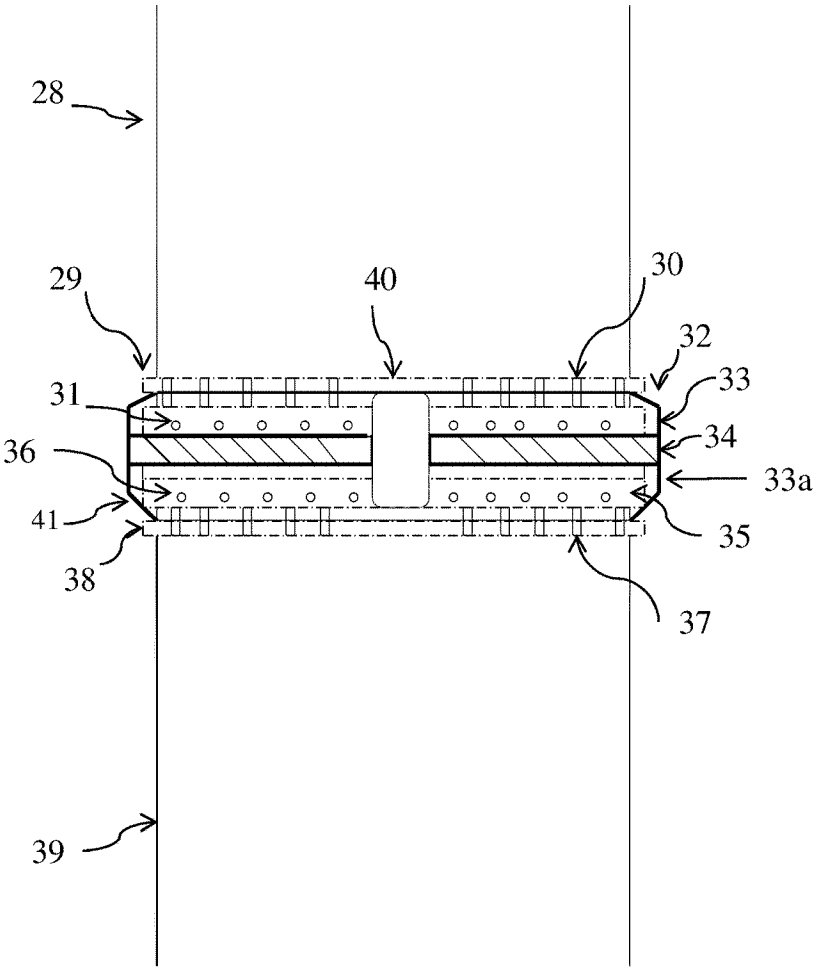
FIG. 4 depicts a cross section of a rotation interface that includes a vertical alignment of two bearing assemblies belonging to an upper 28 and a mid 39 Alpha Body resulting in two points of independent rotation for the machine. The interface is a relationship between upper 31 and lower 36 bearings located at the lower distal end 32 of the upper Alpha Body and the top distal end 41 of the mid Alpha Body. The cross section includes upper 28 and mid 39 cylindrical shells, press fit bearing cups 33, 33*a*, half rings 29, 38, flanged retaining rings 32, 35 and bearings 31, 36, a compression socket 40, bolts 30, 37, and a flanged washer 34.

Independent rotation of each Alpha Body is realized by a relationship between two bearing assemblies, an example being an upper and a lower bearing assembly located at an interface between the upper Alpha Body's lower distal end and the mid Alpha Body's top distal end, the cross section depicted in FIG. 4. An upper press fit bearing cup 33 is friction fitted at the bottom distal end 32 of the upper shell 28 and rests on an upper flanged retaining ring with bearings 31. The upper flanged retaining ring with bearings 31 is oriented so that the lip, which radially extends from one side of the upper retaining ring 31, is in contact with a race located in the upper portion of the upper press fit bearing cup 33. The bearing side of the upper retaining ring 31 rests in a race located in the surface of a flanged washer 34 and serves as a lower point of rotation for the upper Alpha Body.

The flanged washer's 34 other surface has a lip that radially extends down from the washer 34 and into the outer surface area of a race located within a lower press fit bearing cup 33*a* friction fitted at the top distal end 41 of the mid Alpha Body 39. These lower bearings 36 are free to rotate in this race and serve as a top point of rotation for the mid Alpha Body 39. A threaded hole located in the center of the washer 34 accepts a threaded bolt 40, which when tightened, creates a compression socket for the entire bearing assembly.

Half rings 29, 38 and bolts 30, 37 are used to secure the upper and mid Alpha Bodies at the bearing assembly. The outer surface for all press fit bearing cups 33, 33*a* and the lip side of the flanged retaining ring 24 have holes that receive securing bolts 30, 37, which pass through the press fit bearing cups 33, 33*a*, the two half rings 29, 38 located about the same, and into the holes located in the flanged retaining rings 31, 35. Bolting half rings 29, 38 to the flanged retaining ring with bearings 31 is repeated at the mid Alpha Body's top bearing assembly and prevents the machine from rocking or tilting when struck. It is an embodiment of the invention where the weight of the machine, due to the vertical stacking of the alpha bodies, the bearing assemblies, the half rings 29, 38 and bolts 30, 37, and the compression socket 40 for each bearing assembly creates a more stable machine that exhibits little rocking or tilting when struck.

The Base

Figure 6:
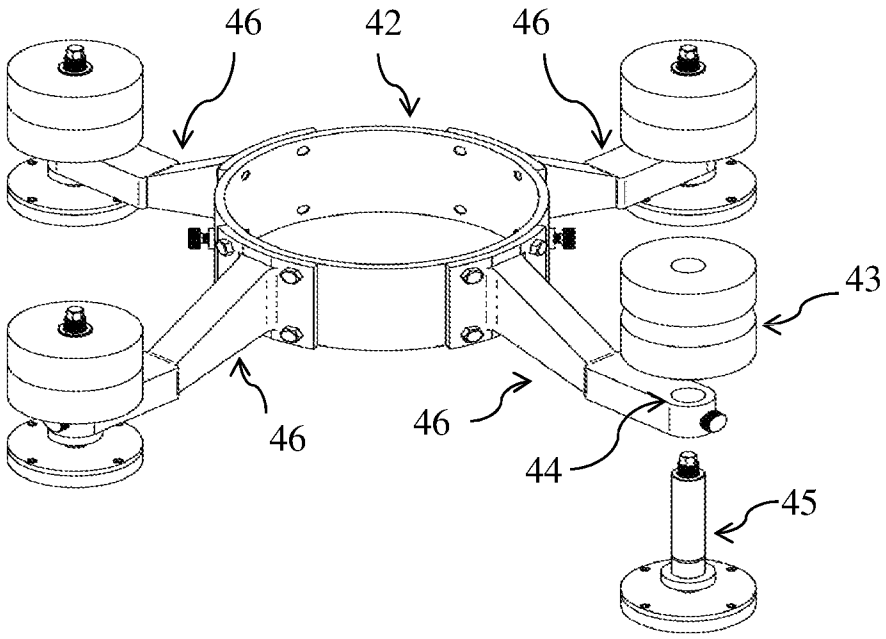
FIG. 6 depicts a balanced base having four legs 46 and balances 45 used to adjust the machine to an even height, where the base includes a ring with a circular cross section 42 having four equally spaced legs 47 around its circumference that pivot and radiate downward and outward towards a floor and has four balances 45 with shafts capable of supporting disc shaped weights 43.

It is an embodiment of the present invention wherein the machine is freestanding and is supported and balanced by a base. From FIG. 6, the base is a ring with a circular cross section 42 having four legs 46 equally spaced about its circumference, where the legs 46 pivot and radiate downward and outward towards a floor and has four dumbbell like balances 45 with shafts capable of supporting disc shaped weights 43. Each leg terminates at a horizontal boss 44, where each boss 44 has a circular opening sized to accept a vertical shaft from a balance 45. The base's open cavity is sized to friction fit with the lip side of a flanged retaining ring with bearings. This leaves the bearing side of the retaining ring free to roll along a race in the surface of the press fit bearing cup supporting the cylindrical shell of the lower Alpha Body. This configuration creates a base point of rotation for the lower Alpha Body.

Figure 7:
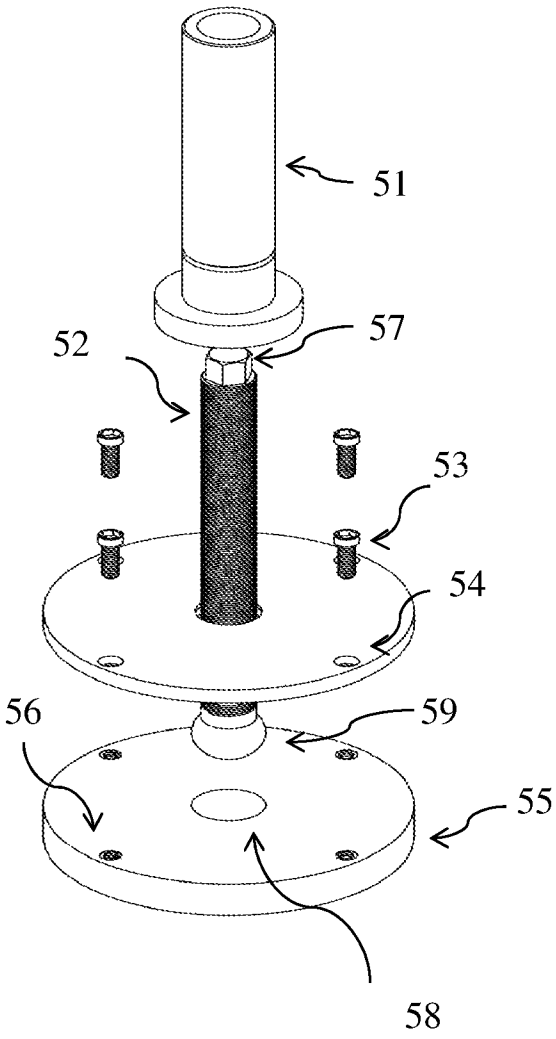
FIG. 7 is an exploded view of the dumbbell like balance used to support the machine. Each balance 50 is a dumbbell like construct that includes a threaded shaft 52 and sleeve 51, bolts 53, and a bottom 55 and upper disc plate 54.

From FIG. 7, the base includes a set of dumbbell like balances 50 for the four legs to rest. Each balance 50 is a dumbbell like construct that includes a threaded shaft 52 and sleeve 51, bolts 53, and a bottom 54 and upper disc plate 55. The threaded shaft 52 is basically a bolt with threads having a round foot 59 at one end and a hexagonal nut 57 tapered at the other. The nut end 57 of the threaded shaft 52 is passed through a center hole 58 of both securing plates 54, 55, such that the round foot 59 of each threaded shaft 52 sets flush against the bottom surface of the bottom plate 55. Each of the four feet serves as a balanced resting point for the machine against a horizontal floor. The threaded shaft 52 is secured by bolting a top securing plate 54 to the bottom securing plate 55. A sleeve 51 is then threaded onto the shaft 52. Once the balances 50 are assembled, each sleeve 51 is vertically passed through a hole located at the boss of each leg. The sleeve acts as an axial shaft for receiving a plurality of weights, where the plurality of weights are circular discs with axial holes slightly larger than a diameter for each sleeve to allow the weight to slip over and onto the same.

Motorized Embodiments

Force from a user's strike can make each of the three Alpha Bodies rotate. However, it is the preferred embodiment of the present invention where the Alpha Bodies are rotated by a motor system. All embodiments of the present invention use at least one electric servo motor to bring about rotation of the alpha bodies. The electric servo motor should support step/pulse or continuous movement, have a motor power connector, and receive digital inputs for direction and speed from a digital controller. Each servo motor should provide enough torque at a speed that will mimic the force exerted from a strike by a live sparring partner, a non-limiting example being a servo motor capable of delivering from about 25 lbs [111.20 N] to about 800 lbs [3558.57 N] of force per strike, enough force to cause micro fractures to key nerve areas by each pair of arms but not to cause significant bone breakage or harm to the user.

For all embodiments, each servo motor has a motor, at least one drive shaft, a feedback device, an amplifier, a motion controller, and a possible power transmission. The electric servo motor can either by AC or DC in nature and may be brushed or brushless. The motor can be of single phase or three phase induction. All servo motors in each embodiment receive programmable martial arts sequences via voltages from a servo motor control, where motion controllers for servo motors are well known within the arts.

We use at least one industrial type servo motor connected to at least one drive shaft extension in contact with the inner walls of each Alpha Body. In another embodiment, three industrial type servo motors rotate each alpha independently by a motor and disc assembly in contact with the inner walls of each Alpha Body.

FIG. 8 depicts the innards of the machine 60 with an industrial servo motor 71 having a dual shaft type motor known within the arts. The upper and lower shafts of the electric servo motor 71 are connected to an upper shaft extension 73 and a lower shaft extension 75. Alpha Bodies 61-63 are stacked to form a hollow column having six points of rotation, as previously described. Each pair of detachable arms is omitted but is intended to be a part of all motorized embodiments.

From FIG. 8, the servo motor 71 is secured to and suspended in the inner cavity of the mid Alpha Body 62 by a mounting bracket 74 that is custom made to the diameter of the motor in use. The servo motor 71 sits flush within a cavity of the mounting bracket 74. The mounting bracket 74 is attached to and rests on a large servo arm 77 that extends to the inner walls of the mid Alpha Body 62 and is secured to the same with bolts that are tightened into brackets that extend from the inner walls of the mid Alpha Body 62.

In this embodiment the electric servo motor's upper and lower drive shafts are fitted with an upper 73 and a lower 75 extension that pass through an upper servo arm 72 and a lower servo arm 76. Generally, the extensions 73 and 75 are long tubular rods. Each servo arm 72 and 76 is similar to a flat propeller with a hole in its center, which is sized to accept the outer diameter of the upper extension 73 and lower extension 75.

Two disc type servo horns 78 connect the motor's 71 upper and lower drive shafts to the upper extension 73 and lower extension 75, where the disc type servo horn 78 is a normal drive shaft fitting known within the arts and where the extensions 73 and 75 are inserted into a flanged mounting located at the disc shaped servo horn 78. The upper 72 and lower 76 servo arms are bolted to brackets 77 that protrude from the inner walls of the upper Alpha Body 61 and the lower Alpha Body 63. The electric servo motor 71 transmits rotational motion to the dual drive shafts, through the upper 73 and lower extensions 75, and finally to the upper 72 and lower 76 servo arms that are bolted to flanges that protrude from the inner walls of the upper Alpha Body 61 and the lower Alpha Body 63. This embodiment will cause the upper Alpha Body 61 and the lower Alpha Body 63 to rotate according to the programming of the servo motor 71. Because the mid servo arm 77 is connected directly to the inner walls of the mid Alpha Body 62 and supports the servo motor bracket 74, only strikes from the user will cause the mid Alpha Body 62 to rotate.

Through a motion controller (not shown), the electric servo motor 71 offers complex motion profiles and patterns for the upper 61 and lower 63 alpha bodies. Because precision is high, the electric servo motor 71 gives precise control of torque, speed, and position of the Alpha Bodies 61 and 63 and arms 72 and 76 due to a closed loop feedback. An external controller ensures that both speed and torque are simultaneously controlled and reduces each Alpha Body's 61 and 63 speed when approaching an end point of rotation and uses the appropriate force required to strike someone at key nerve areas to promote body hardening without causing injury.

A user control panel (not shown but standard in the art of motion control) may be a touch pad or a touch pad display and includes a programmable logic controller, for controlling voltages to the electric servo motor 71. The controller sends voltages to the servo motor 71 that allows the user to program motion sequences that rotates the Alpha Bodies 61 and 63 to initiate striking patterns for a user to block. The user control panel may be provided with a display area for exhibiting the settings of selected patterns for rotation patterns for the Alpha Bodies 61 and 63. It is preferred that the controller sends signals to the electric servo motor 71 to rotate each Alpha Body from about 0° to about 45° to 90° normal to the machine's vertical alignment.

Figure 9:
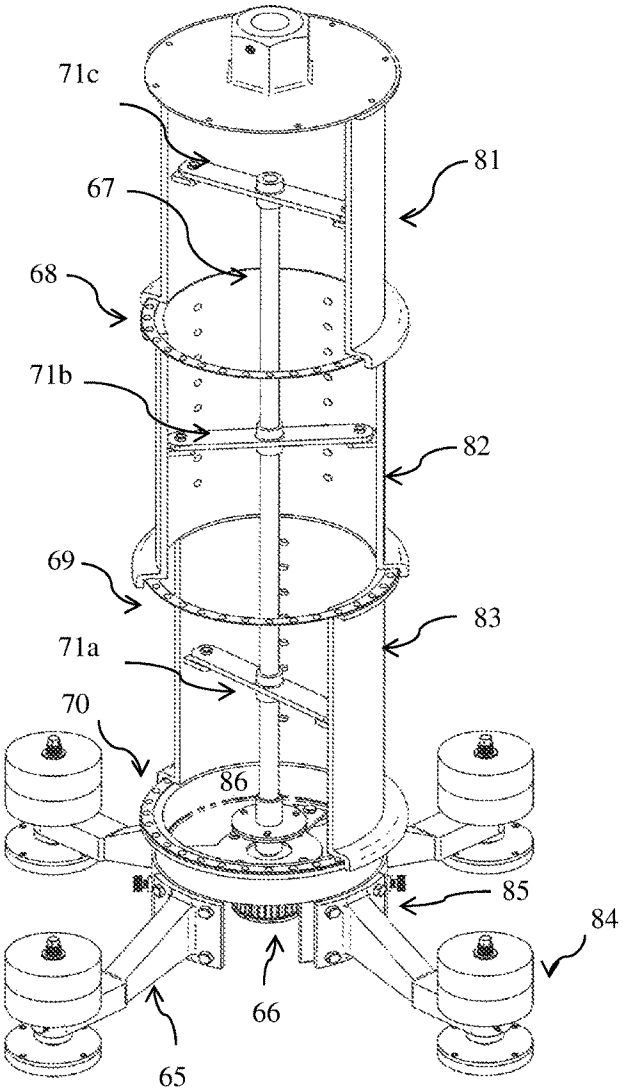
FIG. 9 is a cross section depicting a single motor embodiment with electric servo motor 66 being secured and suspended in the inner cavity of the base 85. The electric servo motor 66 is a single shaft motor. The motor's 66 single drive shaft points upward into the cavity of the machine and is connected to a single drive shaft extension 67 via a disc type servo horn 86. The singular drive extension 67 passes through the centers of a lower 71*a*, mid 71*b*, and an upper 71*c* servo arm. The electric servo motor 66 transmits rotational motion to the single drive shaft, through the extension 67, and finally to each of the lower 71*a*, mid 71*b*, and upper 71*c* servo arms. This embodiment will cause each Alpha Body 81-83 to rotate and move in concert according to the programming of the servo motor 66.

FIG. 9 is another embodiment of the present invention, where an electric servo motor 66 is secured and suspended in the inner cavity of the base 85. The electric servo motor 66 is a single shaft motor and is known within the arts. The servo motor 66 is connected to a mounting bracket secured to the inner walls of the base 85 via bolts that are tightened into three equally spaced brackets that extend from the inner walls of the base 85. From the cut away view, three Alpha Bodies 81-83 are stacked to form a hollow column having six points of rotation, as previously described. Each pair of detachable arms is omitted but is intended to be a part of all motorized embodiments.

The embodiment depicted in FIG. 9 has the motor's 66 drive shaft pointed upwards into the cavity of the machine and is connected to a single drive shaft extension 67 via a disc type servo horn 86. The extension 67 from the drive shaft consists of a long tubular rod having one end inserted over the motor's 66 upwardly pointing drive shaft via the disc shape servo horn 86. The singular drive extension 67 passes through the centers of a lower 71*a*, mid 71*b*, and an upper 71*c* servo arm. The holes at the center of each servo arm 71*a*-71*c* are sized to friction fit and accept the outer diameter of the drive shaft extension 67 that is connected to the servo motor's 66 drive shaft. Each servo arm 71*a*-71*c* extends to both sides of its respective Alpha Body's 81-83 inner cavities, where they are secured by bolts that pass through either side of each servo arm 71*a*-71*c* and are tightened into brackets that extend from these inner walls. The electric servo motor 66 transmits rotational motion to the single drive shaft, through the extension 67, and finally to each of the lower 71*a*, mid 71*b*, and upper 71*c* servo arms. This embodiment will cause each Alpha Body 81-83 to rotate and move in concert according to the programming of the servo motor 66.

The embodiment depicted in FIG. 9 may also take advantage of using a motion controller (not shown but mentioned in the previous embodiment), where the electric servo motor 66 offers complex motion profiles and patterns for all Alpha Bodies 81-83 rotating in concert. Because precision is high, the electric servo motor 66 gives precise control of torque, speed, and position of all Alpha Bodies 81-83 due to a closed loop feedback.

A user control panel (not shown but standard in the art of motion control) may be a touch pad or a touch pad display and includes a programmable logic controller, for controlling voltages to the electric servo motor 66. The controller sends voltages to the servo motor 66 that allows the user to program motion sequences that rotates all Alpha Bodies 81-83 to initiate striking patterns for a user to block. The user control panel may be provided with a display area for exhibiting the settings of selected patterns for rotation patterns for all Alpha Bodies 81-83. It is preferred that the controller sends signals to the electric servo motor 66 to rotate each Alpha Body from about 0° to about 45° to 90° normal to the machine's vertical alignment.

Figure 10:
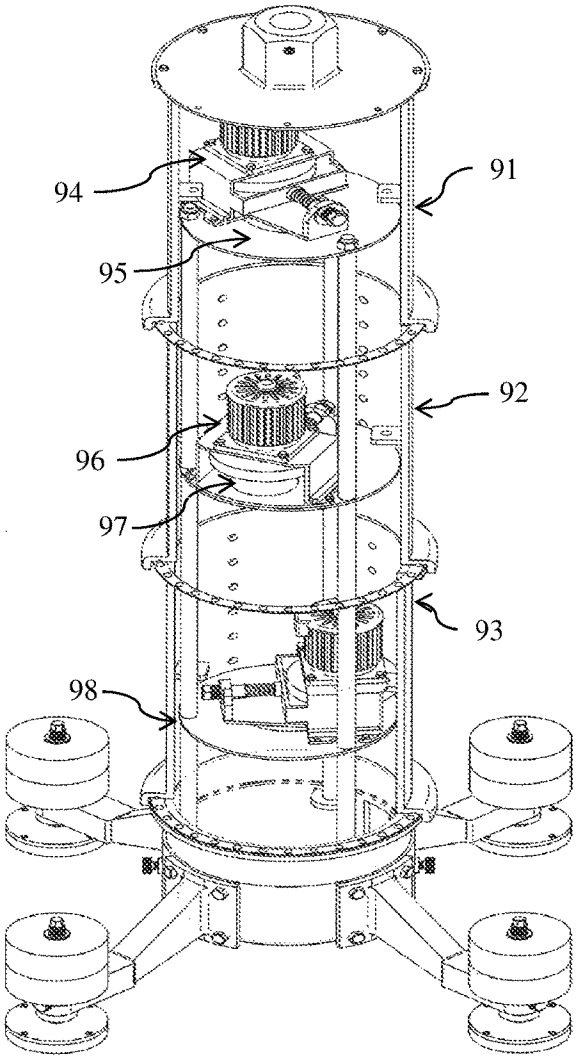
FIG. 10 is a cross section depicting the upper 91, mid 92, and lower 93 Alpha Bodies each having their own programmable servo motor 96 to bring about independent rotation from each other. Each servo motor 96 is oriented to have its drive shaft pointing downwards and is secured onto a rubber disc 95 by a front mounting bracket 94. The single drive shaft is mated to a disc shape servo horn 97. Each of the three servo motors 96 transmit rotational motion to a single drive shaft and servo horn 97, through the rubber disc 95, and onto the inner walls of each respective Alpha Body 91-93.

The embodiment depicted in FIG. 10 discloses the use of three servo motors 96 for independent rotation of each Alpha Body 91-93. Because the motorized construct is identical in each Alpha Body 91-93, numerical designations are given to the clearest depiction of the highlighted element regardless of which Alpha Body 91-93 it is in. From the cut away view, the upper 91, mid 92 and lower 93 Alpha Bodies are stacked to form a hollow column having six points of independent rotation, as previously described. The upper 91, mid 92, and lower 93 Alpha Bodies each have their own electric servo motor 96 to bring about independent rotation from each other. Each pair of detachable arms is omitted but is intended to be a part of all motorized embodiments.

Each servo motor 96 is oriented to have its drive shaft pointing downwards and is secured onto a rubber disc 95 by a front mounting bracket 94. The single drive shaft is mated to a disc shape servo horn 97 that is friction fitted into a hole about the rubber disc 95 that is sized to the outer diameter of the servo horn 97. Each of the three servo motors 96 transmit rotational motion to a single drive shaft and servo horn 97, through the rubber disc 95, and onto the inner walls of each respective Alpha Body 91-93. This transference of rotational energy to the walls of each Alpha Body 91-93 will cause rotation due to the independent bearing interfaces located at each distal end of an Alpha Body 91-93 according to the controlled programming for each servo motor 96.

The rubber disc 95 is cut to have an outer diameter that allows the disc 95 to set flush against the inner walls of an Alpha Body 91-92. Each rubber disc 95 rests between spaces cut into stabilizing rods 98 that run the length of the inside of the machine. Each rod 98 is positioned equal distance around the outer diameter of each rubber disc 95 and is secured by a nut and bolt at the top surface of a rubber disc 95 in the upper Alpha Body 91. The rubber disc 95 may be made from rubbers, including but not limited to, Styrene Butadiene Rubber (SBR), Neoprene, or any industrial grade rubber that can hold up to the abrasion of many Alpha Body 91-93 rotations. The thickness of each rubber disc 95 should be such to hold the weight of a standard servo motor 96.

The embodiment depicted in FIG. 10 may also take advantage of using a single or three independent motion controllers (not shown but mentioned in the previous embodiments), where the electric servo motor 96 offers complex motion profiles and patterns for all Alpha Bodies 91-93 rotating independently. Because precision is high, each of the three electric servo motors 96 give precise control of torque, speed, and position of all Alpha Bodies 91-93 due to a closed loop feedback.

A user control panel (not shown but standard in the art of motion control) may be a touch pad or a touch pad display and includes a programmable logic controller, for controlling voltages to each of the three electric servo motors 96. The controller sends voltages to each servo motor 96 that allows the user to program motion sequences that rotates all Alpha Bodies 81-83 independently to initiate striking patterns for a user to block. The user control panel may be provided with a display area for exhibiting the settings of selected patterns for rotation patterns of each motor that controls an Alpha Body 81-83. It is preferred that the controller sends signals to each of the three electric servo motors 96 to rotate each Alpha Body from about 0° to about 45° to 90° normal to the machine's vertical alignment.

Machine Size

Referring to FIG. 3, the cylindrical shell 21, being a main construct of an Alpha Body, includes a piece of cut sheet metal that has been rolled into a hemispherical shape, where the edges are fastened or welded smooth to form a hollow tube that has a circumference from about 20" to about 44" and has a height from about 15" to about 34". It is an embodiment of the present invention wherein the upper Alpha Body has a slightly greater length than the mid and lower Alpha Bodies as to mimic the upper proportions of the human body relative to the lower torso and thigh and knee areas. Each cylindrical shell 21 is then friction fit with a press fit bearing cups 22 at both distal ends 27 and 27*a*. When the Alpha Bodies are vertical stacked, six points of rotation are created at interfaces having bearing assemblies including the lid and upper Alpha Body, the upper and mid alpha bodies, the mid and lower alpha bodies, and the lower Alpha Body and base.

From FIG. 2*b*, once the vertically aligned Alpha Bodies 11, 12, and 13 are secured with by half rings as described above, each Alpha Body 11, 12, and 13 may rotate to the right or to the left from about 0° to about 90° when struck by force or made to rotate by at least one electric servo motor. The height of the totally assembled machine 10 from the base, being horizontally flush to the floor to the apex of the pull up bar 16, is from about 5 feet to about 8 feet. The non-padded elements of the machine 10 may be made from metal, wood, hard plastics, or any combinations thereof. However, it is an embodiment of the invention wherein the non-padded elements of the machine 10 are made from a tempered steel alloy.

The arms 17 for each Alpha Body are detachable and are padded to protect the user from overly hard contact. The arms are positioned on each Alpha Body to strike and form hard tissue near key nerve points including but not limited to: the radial nerve (top of the forearm), the ulnar nerve (underside of the forearm), the peroneal nerve (outside of thigh), the femoral nerve (inside of the thigh), and the abdomen (mid torso).

The top distal end of the upper Alpha Body 11, 12, and 13 is fully covered by a circular lid 18 having an appropriate circumference and a hexagonal nut that extends from the lid's center that threadly accepts a locating member 18*a*. Two suspension arms are made to form a T-shaped bar that frictions fits into the locating member 18*a*. One portion of the T-shaped bar has left and right handles and acts as a pull up bar 16. The other end of the T-shaped bar passes through the locating member 18*a*. A speed bag 15 hangs from a shaft that passes through a hole located at the end of this portion of the T-shaped bar and is secured by a bolt.

What has been described above includes various exemplary aspects of a machine that facilitates martial arts training, which simulates sparring with a live partner and provides a safe tool for body hardening. It is, of course, not possible to describe every conceivable combination of components or methodologies for purposes of describing these aspects, but one of ordinary skill in the art may recognize that many further combinations are possible. The invention is not limited to any particular dimensions of the various elements, but the above are non-limiting examples of practical sizes. Accordingly, the aspects described herein are intended to embrace all such alterations, modifications and variations that fall within the spirit and scope of the following claims.

I claim:

1. A machine that simulates martial arts sparring comprising:

a.) an upper, a mid, and a lower Alpha Body that are vertically aligned and secured by interfaces at two locations and wherein a programmable servo motor is configured to rotate each or a plurality of the Alpha Bodies;

b.) wherein the interfaces are located firstly between a bottom distal end of the upper Alpha Body and a top distal end of the mid Alpha Body, and secondly between a bottom distal end of the mid Alpha Body and a top distal end of the lower Alpha Body;

c.) wherein each interface includes an upper press fit bearing cup and a lower press fit bearing cup, wherein the upper press fit bearing cup has a race for accepting an upper retaining ring with bearings, wherein the lower press fit bearing cup has a race for accepting a lower retaining ring with bearings, and wherein the press fit bearing cups each have holes for accepting threaded bolts about an outer surface thereof;

d.) the retaining rings with bearings each having a modified flange with holes for accepting the respective threaded bolts;

e.) a washer with a race at one surface thereof for accepting the upper retaining ring with bearings, the washer having a radially extending lip from another surface thereof for accepting the race of the lower press fit bearing cup, and the washer further having a threaded bore for accepting a central threaded bolt which, when tightened, creates a compression socket for the interface, coupling the press fit bearing cups together; and f.) an upper half ring and a lower half ring, wherein the upper half ring is coupled to the outer surface of the upper press fit bearing cup, wherein the lower half ring is coupled to the outer surface of the lower press fit bearing cup, and wherein the half rings each have holes for accepting the respective threaded bolts.

2. The machine that simulates martial arts sparring of claim 1, wherein a bottom distal end of the lower Alpha Body is friction fit with a bottom press fit bearing cup having a bottom retaining ring with bearings and is supported by a balanced base that includes a ring having a circular cross section, a cavity, and four legs equally spaced about a circumference thereof, wherein each leg pivots and radiates outwardly and downwardly terminating at a boss having a hole sized and positioned to vertically accept a sleeve from a dumbbell like balance.

3. The machine that simulates martial arts sparring of claim 1, wherein the programmable servo motor has a single drive shaft that is secured to and suspended in an inner cavity of a base by a mounting bracket, wherein the mounting bracket is secured to inner walls of the base by bolts that are tightened into three equally spaced brackets that extend from the inner walls of the base, wherein the single drive shaft is pointed upwards into a cavity of the machine and is connected to a single drive shaft extension via a disc shape servo horn, and wherein the singular drive shaft extension passes through centers of a lower, a mid, and an upper servo arm, wherein each of the upper, mid, and lower servo arms extends to opposing sides of an inner cavity of a respective Alpha Body and is secured by bolts that pass through and are tightened into brackets that extend from inner walls of each respective Alpha body and mate with opposing sides of each respective servo arm.

4. The machine that simulates martial arts sparring of claim 1, wherein the programmable servo motor is secured to and suspended in an inner cavity of an Alpha Body and is oriented to have a single drive shaft pointing downwards into a disc shape servo horn that is friction fitted into a hole about a rubber disc, wherein the hole in the rubber disc is sized to an outer diameter of the disc shape servo horn, wherein the programmable servo motor is secured onto the rubber disc by a front mounting bracket, wherein the rubber disc is cut to have an outer diameter that allows the rubber disc to set flush against inner walls of an Alpha Body, and wherein each rubber disc rests between spaces cut into stabilizing rods that run a length of an inside of the machine.

5. The machine that simulates martial arts sparring of claim 1, wherein the machine comprises three programmable servo motors, wherein the three programmable servo motors are respectively secured to and suspended in an inner cavity of each of the upper, mid, and lower Alpha Bodies, wherein each of the three programmable servo motors is oriented to have a single drive shaft pointing downwards into a disc shape servo horn that is friction fitted into a hole about a rubber disc, wherein the hole of each rubber disc is sized to an outer diameter of each respective disc shape servo horn, wherein each of the three programmable servo motors is respectively secured onto each rubber disc by a front mounting bracket, wherein each of the three rubber discs is cut to have an outer diameter that allows each rubber disc to set flush against inner walls of the respective upper, mid, and lower Alpha Bodies, and wherein each of the three rubber discs respectively rests between spaces cut into stabilizing rods that run a length of an inside of the machine.

6. The machine that simulates martial arts sparring of claim 1, wherein each Alpha Body includes a pair of detachable arms.

7. The machine that simulates martial arts sparring of claim 1, wherein the upper, the mid, and the lower Alpha Bodies are independently rotatable at the interface located between the bottom distal end of the upper Alpha Body and the top distal end of the mid Alpha Body, and the interface located between the bottom distal end of the mid Alpha Body and the top distal end of the lower Alpha Body.

8. The machine that simulates martial arts sparring of claim 2, wherein each dumbbell like balance is a construct comprising a threaded shaft and the sleeve, bolts, and a bottom disc plate and an upper disc plate, wherein the bottom disc plate is weighted.

9. The machine that simulates martial arts sparring of claim 1, wherein six points of rotation are created that includes a top retaining ring with bearings located between a lid and the upper Alpha Body, the interface located between the upper and mid Alpha Bodies, the interface located between the mid and lower Alpha Bodies, and a bottom retaining ring with bearing located between the lower Alpha Body and a base.

10. The machine that simulates martial arts sparring of claim 1, wherein the programmable servo motor is programmed with rotation sequences that mimic strikes from a live sparring partner and operates at speeds that can deliver from 25 lbs [111.20 N] to 800 lbs [3558.57 N] of force to cause micro fractures to key nerve areas of a user by a pair of arms of the machine.

11. The machine that simulates martial arts sparring of claim 6, wherein each detachable arm of the pair of detachable arms is strategically placed so that a user may strike or defend strikes from the machine at targeted nerve areas on their forearms, torso, and/or thighs including: a radial nerve (top of the forearm), an ulnar nerve (underside of the forearm), a peroneal nerve (outside of the thigh), a femoral nerve (inside of the thigh), and the abdomen (mid torso), wherein such strikes to or from the user to the pair of detachable arms safely promotes the formation of calcium deposits and scar tissue about these nerve areas to give the body of the user a hardened feel.

12. The machine that simulates martial arts sparring of claim 1, wherein the programmable servo motor has dual drive shafts motor secured to and suspended in an inner cavity of the mid Alpha Body by a mounting bracket that is attached to and rests on a large servo arm that extends to inner walls of the mid Alpha Body and is secured to the same with bolts that are tightened into brackets that extend from the inner walls of the mid Alpha Body, and wherein the dual drive shafts of the programmable servo motor are respectively mated to an upper shaft extension and a lower shaft extension respectively via a servo horn located at an end of each of the dual drive shafts, wherein the upper and lower extensions respectively pass through an upper servo arm and a lower servo arm, each servo arm respectively connected to inner walls of the upper and lower Alpha Bodies.

13. The machine that simulates martial arts sparring of claim 6, wherein ends of each pair of detachable arms are easily and respectively fitted with a pair of boxing or kicking pads such that the machine is configured to give a user a feel of a simulated striking practice for targeted jabs and kicks and wherein the pair of boxing or kicking pads can be jointly connected to the ends of the pair of detachable arms to give each boxing or kicking pad a point of articulation configured to simulate movement of a human wrist when struck.

14. The machine that simulates martial arts sparring of claim 13, wherein said pair of boxing or kicking pads have lighting elements including at least one of diodes, fiber optics, or any combinations thereof connected to an electrical timing circuit that gives lighted sequences about said pair of boxing or kicking pads being striking sequences for the user to follow.

15. The machine that simulates martial arts sparring of claim 8, wherein the sleeve of each dumbbell like balance is vertically passed through the hole located at the boss of each leg, the sleeve acting as an axial shaft for receiving a plurality of weights, the plurality of weights being circular discs with axial holes slightly larger than a diameter of each sleeve, wherein one or a plurality of the plurality of weights are slipped over and onto each sleeve.

16. The machine that simulates martial arts sparring of claim 1, wherein a top of the upper Alpha Body is covered by a lid that is connected to a pull up bar and boxing speed bag.

17. The machine that simulates martial arts sparring of claim 1, wherein the programmable servo motor is connected to a motion controller that controls speed, torque, and direction of the programmable servo motor via a touch pad or a touch pad display and includes a programmable logic controller for controlling voltages to the programmable servo motor that allows a user to program motion sequences that rotate the Alpha Bodies to initiate striking patterns for the user to block.

* * * * *